US006053759A

United States Patent [19]

Kunert

[11] Patent Number: 6,053,759

[45] Date of Patent: Apr. 25, 2000

[54] VEHICLE DOCK FOR A PORTABLE DATA COLLECTION TERMINAL

[75] Inventor: Steven R. Kunert, Cedar Rapids, Iowa

[73] Assignee: Intermec IP Corp., Woodland Hills, Calif.

[21] Appl. No.: 08/966,209

[22] Filed: Nov. 7, 1997

Related U.S. Application Data

[60] Provisional application No. 60/030,726, Nov. 8, 1996.

[51] Int. Cl.[7] ..... H01R 13/64

[52] U.S. Cl. ..... 439/376; 364/709.04

[58] Field of Search ..... 439/157, 152, 439/153, 680, 357, 326, 341, 376, 929; 361/732, 809; 364/708.1; 235/472; 709/222, 250; 708/134; 320/107, 114, 115

[56] References Cited

U.S. PATENT DOCUMENTS

| | | | |
|---|---|---|---|
| 4,701,003 | 10/1987 | Gruet | 439/680 |
| 4,773,032 | 9/1988 | Uehara et al. | 364/DIG. 2 |
| 5,052,943 | 10/1991 | Davis | 439/357 |
| 5,317,691 | 5/1994 | Traeger | 709/250 |
| 5,371,858 | 12/1994 | Miller et al. | 709/222 |
| 5,394,306 | 2/1995 | Koenck et al. | 361/809 |
| 5,465,207 | 11/1995 | Boatwright et al. | 364/424.01 |
| 5,466,170 | 11/1995 | Pavek | 439/374 |
| 5,484,991 | 1/1996 | Sherman et al. | 235/472 |
| 5,517,434 | 5/1996 | Hanson et al. | 364/708.1 |
| 5,627,727 | 5/1997 | Aguilera et al. | 361/686 |

*Primary Examiner*—Khiem Nguyen
*Assistant Examiner*—Michael C. Zarroli
*Attorney, Agent, or Firm*—Suiter & Associates

[57] ABSTRACT

A docking apparatus for docking a portable data collection terminal in a vehicle is disclosed. The docking apparatus comprises a housing having a terminal cup mounted therein. The terminal cup may pivot about a horizontal axis to facilitate insertion and removal of the data collection terminal. A lever arm assembly may be depressed by a user causing the terminal cup to pivot to facilitate removal of a portable data collection terminal. The lever arm assembly may provide guides which position the data collection terminal for insertion into the terminal cup and prevent lateral movement of the portable data collection terminal once it is fully inserted therein. A retention pin assembly may secure the portable data collection terminal within the docking apparatus.

22 Claims, 5 Drawing Sheets

VEHICLE DOCK FOR A PORTABLE DATA COLLECTION TERMINAL

CROSS REFERENCES

The present invention claims the benefit, under 35 U.S.C. § 119, of U.S. Provisional Application Ser. No. 60/030,726, filed Nov. 8, 1996. Said U.S. Provisional Application Ser. No. 60/030,726 is herein incorporated by reference in its entirety.

TECHNICAL FIELD

The present invention relates generally to portable data collection terminals, and more specifically to apparatus for docking a portable data collection terminal in a vehicle such as a truck, delivery van, or the like.

BACKGROUND OF THE INVENTION

Often, it is desirable to mount a portable data collection terminal in a vehicle such as a truck, van, or the like. For example, a portable data collection terminal may be utilized by a driver on a delivery route for a variety of purposes such as recording sales and tracking inventory delivered to customers. In such applications, the data collection terminal may be placed in a docking apparatus mounted within the vehicle. Typically, this docking apparatus provides a means of powering the terminal or recharging the data terminal's internal batteries, and transferring data stored in its internal memory to a central computer for processing.

Preferably, vehicle mounted docks provide positive retention of the data terminal while the vehicle is in motion to prevent jarring of the data terminal from the docking apparatus. However, many modern data collection terminals are designed with increased emphasis on ergonomics, employing such features as rounded housings and keyboards or an integral pistol grip. These features may make the data terminal more difficult to secure within the vehicle dock.

Accordingly, it would be advantageous to provide an apparatus for docking a portable data collection terminal having an ergonomically designed housing in a vehicle such as a truck, delivery van or the like wherein the apparatus facilitates ease of insertion and removal of a portable data collection terminal by the user.

SUMMARY OF THE INVENTION

Therefore, an object of the present invention is to provide an apparatus for docking a portable data collection terminal having an ergonomically designed housing in a vehicle such as a truck, delivery van or the like.

It is another object of the present invention that the apparatus facilitate ease of insertion and removal of a portable data collection terminal by the user.

Yet another object of the present invention is to provide a vehicle docking apparatus for coupling a portable data collection terminal to an electrical power source and data communication apparatus.

The present invention provides a novel apparatus for docking a portable data collection terminal in a vehicle such as a truck, delivery van, or the like. The docking apparatus comprises a housing having a terminal cup mounted therein. The terminal cup may pivot about a horizontal axis to facilitate insertion and removal of the data terminal and may include channels into which the data collection terminal may be removably inserted. A lever arm assembly may be depressed by a user causing the terminal cup to rotate and allowing removal of the data terminal. The lever arm assembly may provide guides which position the data collection terminal for insertion into the terminal cup and prevent lateral movement of the portable data collection terminal once it is fully inserted therein. A retention pin assembly may secure the portable data collection terminal within the docking apparatus.

It is to be understood that both the foregoing general description and the following detailed description are exemplary and explanatory only and are not restrictive of the inventions claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to the presently preferred embodiment of the invention, an example of which is illustrated in the accompanying drawings.

Figure 1:
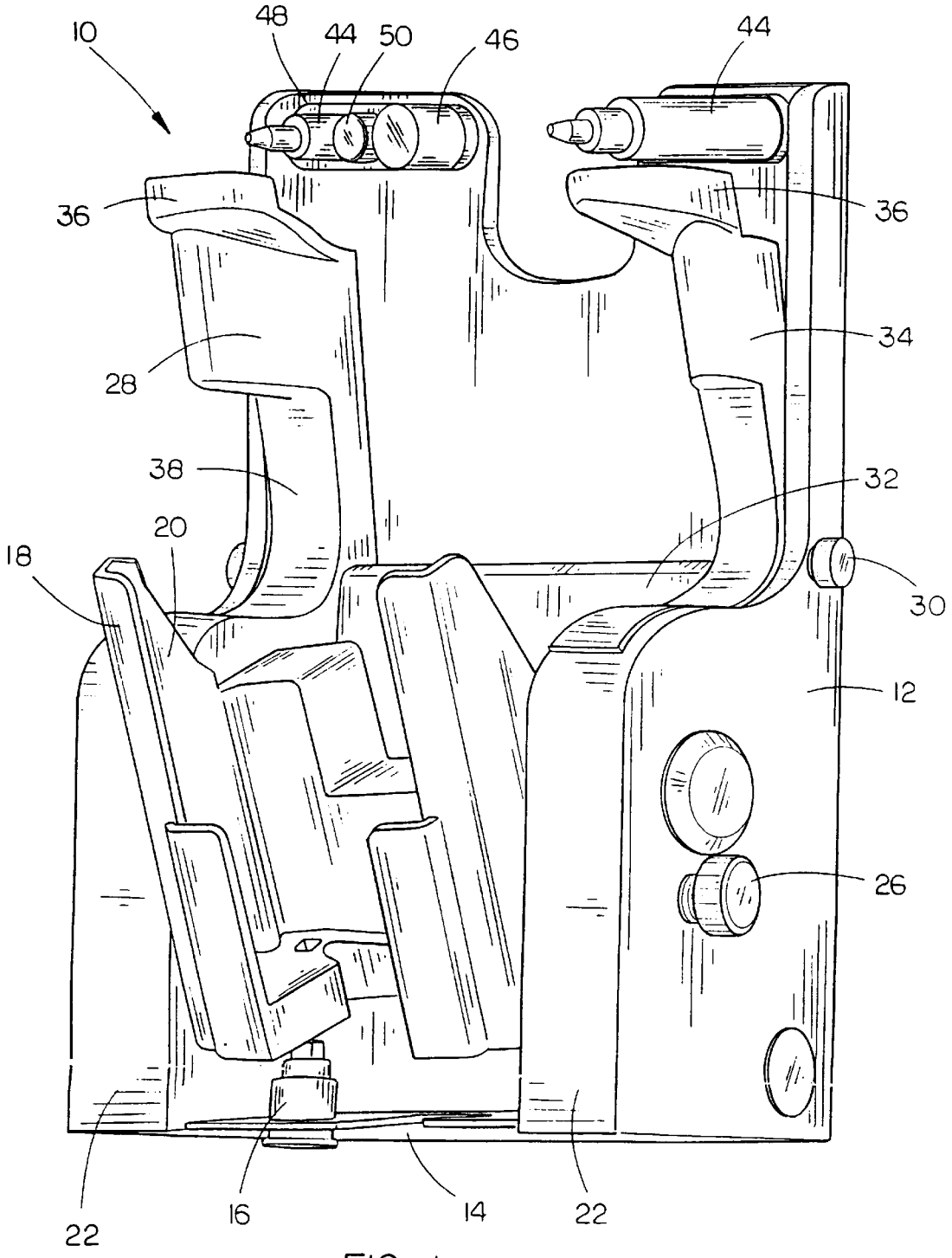
FIG. 1 is a perspective view illustrating a vehicle docking apparatus according to an exemplary embodiment of the present invention.

FIG. 1 depicts a vehicle dock 10 according to an exemplary embodiment of the present invention. Preferably, the vehicle dock 10 comprises a housing 12 that may be mounted to a surface within the interior cabin of a vehicle such as a truck, delivery van, or the like. Alternatively, the housing may be mounted to a vehicle typically utilized in a warehouse such as, for example, a forklift or cart. The housing 12 may include a bottom cover plate 14 through which a connector 16 may extend to provide interconnection between the docked data collection terminal and an electrical power source such as the vehicle's electrical system. This connector 16 may also provide interconnection between the data collection terminal and a radio transceiver, computer, printer or the like.

A terminal cup 18 having channels 20 into which the housing of the portable data collection terminal may be removably inserted, may be mounted between two distal side walls 22 of the housing 12. In a preferred embodiment, the interior shape 24 of the channels 20 may conform to the exterior shape of the data terminal's housing such that the data terminal may be held securely within the channels 20 once inserted by the user. The terminal cup 18 may have a frontal opening to allow access by the user to the keyboard and display of the data terminal. Contacts may be disposed in a bottom inside surface of the terminal cup 18. These contacts may comprise spring contacts, surface contacts, or the like which may mate with contacts at the base of the data collection terminal's housing to provide electrical interconnection between the data terminal and the dock 10. To facilitate insertion and removal of the portable data collection terminal, the terminal cup 18 may pivot in a horizontal plane about a shoulder axis. Shoulder screws 26 consisting of thumbscrews or the like may extend through holes in the side walls 22 of the housing 12 into the sides of the terminal cup 18 at this shoulder axis to hold the terminal cup 18 within the housing 12.

A lever arm assembly 28 may be mounted above the terminal cup 18 between distal side walls 22 of the housing 12. This assembly preferably comprises lever arms 34 extending upward from a base 32. Screws 30 such as thumb screws or the like may extend through holes in the side walls 22 of the housing 12 into the sides of the lever arm assembly base 32. These screws 34 hold the lever arm assembly 28 in the housing 12 and provide a pivot so that the lever arm assembly 28 may rotate about a horizontal axis. Additionally, the lever arm assembly base 32 may rotate the terminal cup 18 to allow insertion and removal of the portable data collection terminal. Terminal guides 36 comprising protrusions molded onto the lever arms 34 may assist the user in positioning the portable data collection terminal for insertion into the terminal cup 18. These guides 36 may also prevent lateral movement of the portable data collection terminal once it is fully inserted within the terminal cup 18 and provide a surface 38 which the user may press to push the lever arms 34 back and release the terminal cup 18 so that the data terminal may be removed from the dock 10. Flat angled surfaces 38 may be molded into the lever arms 34 adjacent to and below the terminal guides 36 to allow the user to insert his hand beneath the data terminal. In this fashion, the back of the user's hand or fingers may press this angled surface 38 and release the terminal so that it can be removed from the dock 10 with one hand.

A retention pin assembly 40 may extend perpendicularly from the upper part of a rear support wall 42 of the housing 12. In the embodiment shown, this assembly may comprise two sets of pins 44 & 46. A first set of pins 44 may be shaped to mate with corresponding holes or apertures in the data terminal's housing to provide secure retention of the data terminal within the dock 10 when the terminal cup 18 is in the upright position (see FIG. 2). When the retention pin assembly 40 is rotated 180 degrees, a second, shorter set of pins 46 may be positioned to secure a data terminal having a pistol grip attached (see FIG. 3). Preferably, the retention pin assembly 40 may be mounted on a rotatable base plate 48 secured to the housing by a thumbscrew 50. This base plate 48 may have one or more guide pins (not shown) on the back thereof extending into holes in the housing 12. When the retention pin assembly 40 is rotated to its desired position, the thumbscrew 50 may be tightened to insert the guide pins into the corresponding holes in the housing, thereby preventing rotation of the retention pin assembly 40.

Figure 2:
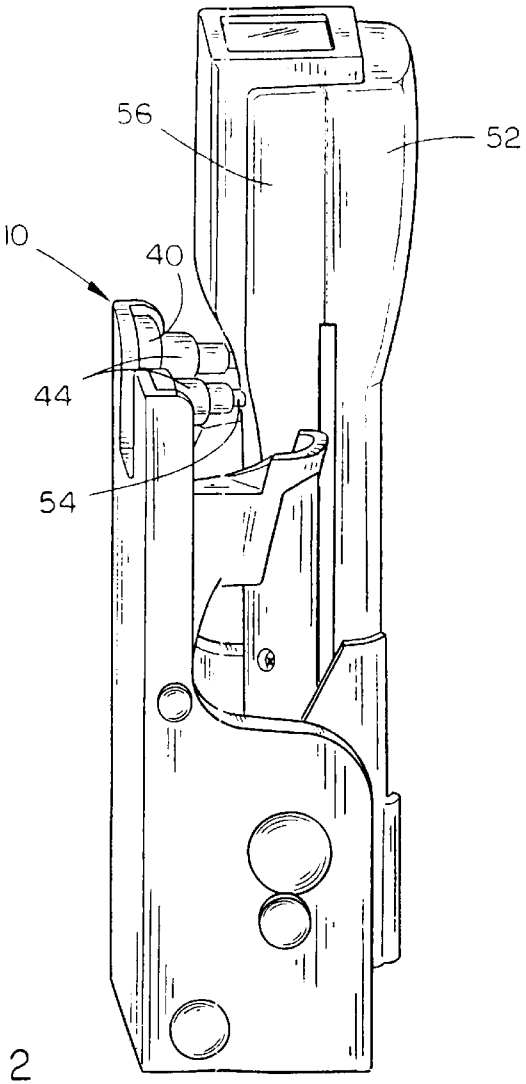
FIG. 2 is a perspective view depicting a portable data collection terminal docked in the vehicle docking apparatus shown in FIG. 1.

FIG. 2 depicts a portable data collection terminal such as a NORAND® 6400 data collection terminal 52 docked within the vehicle dock 10 described in FIG. 1. After insertion of the data terminal 52 by the user, the terminal cup 18 preferably rotates to its upright position allowing the first set of retention pins 44 of the adjustable retention pin assembly 40 to engage holes 54 disposed in the back of the data terminal's housing 56. In this manner, the data terminal 52 may be securely held within the vehicle dock 10 while the vehicle is in motion.

Figure 3:
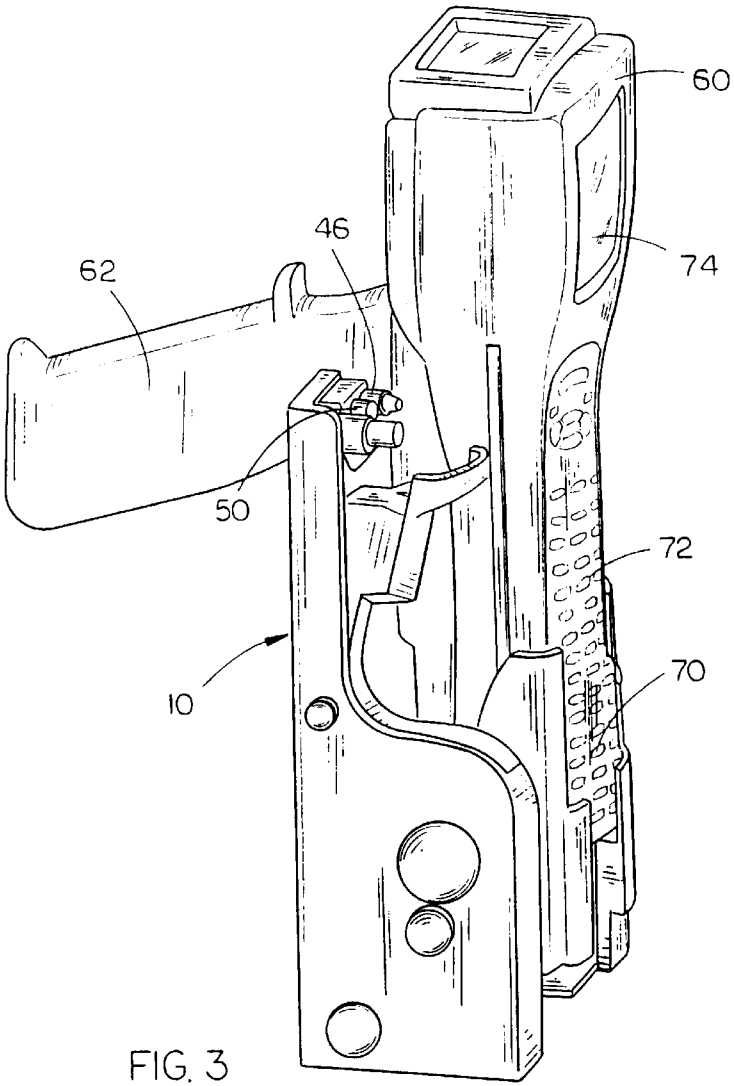
FIG. 3 is a perspective view depicting a portable data collection terminal having a pistol grip docked in the vehicle docking apparatus shown in FIG. 1.

As shown in FIG. 3, the retention pin assembly 40 may be rotated 180 degrees to align the shorter set of retention pins 46 with the housing 56 of the data terminal 52. The thumbscrew 50 may be tightened to hold the retention pin assembly 40 in this position. Thus, the same dock 10 may be used to dock a data terminal 60 having a pistol grip 62 for use with an integral laser scanner or the like. Preferably, the rear support wall 42 of the housing 12 may have an opening or notch 64 molded therein. The pistol grip 62 may protrude through this opening 64 when the data terminal 60 is placed in the dock 10. An opening 66 in the forward face of the terminal cup 18 may allow access by the user to the data terminal's keyboard 68.

Figure 5:
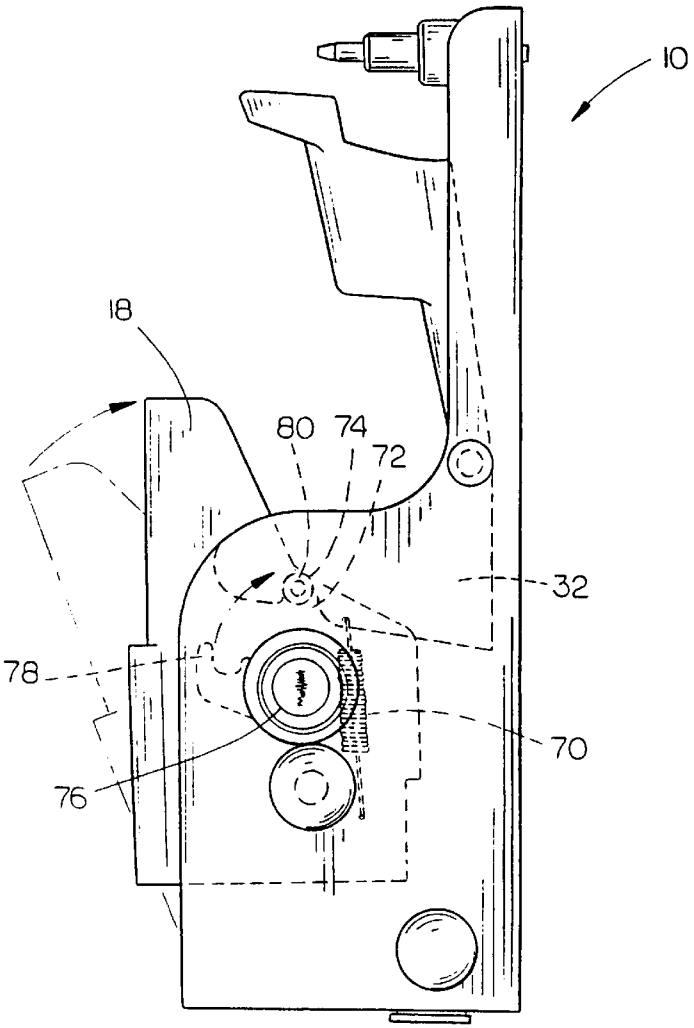
FIG. 5 is a side elevational view of the docking apparatus shown in FIG. 1 illustrating the terminal cup rotated to its closed position.
Figure 4:
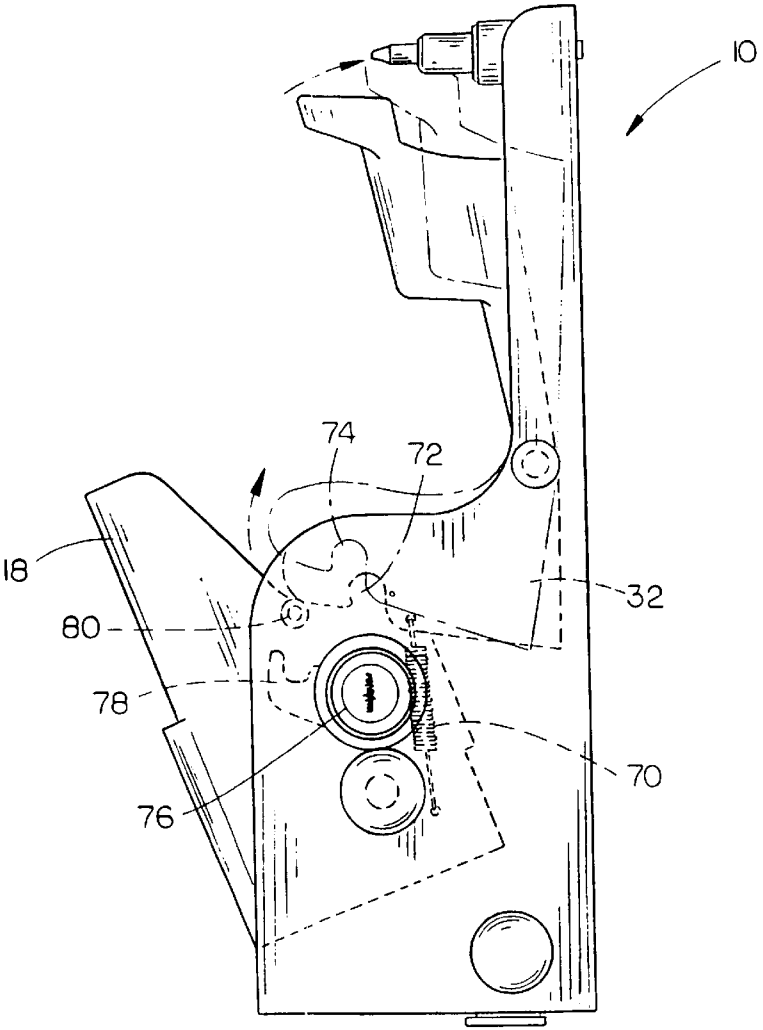
FIG. 4 is a side elevational view of the docking apparatus shown in FIG. 1 illustrating the forward rotation of the terminal cup to facilitate insertion of a portable data collection terminal.

FIGS. 4 and 5 illustrate the forward rotation of the terminal cup 18 to facilitate insertion and removal of a portable data collection terminal from the dock 10. A tension spring 70 may extend between points on the terminal cup 18 and a the lever arm assembly 28. This tension spring 70 preferably holds the lever arm assembly 28 in position to latch the terminal cup 18 in the upright position by means of a rounded tab 72 molded onto an upper surface of the terminal cup 18. This tab 72 slides into a notch 74 in the base 32 of the lever arm assembly 28 when the lever arm assembly 28 returns to its upright position. The tension spring 70 may also preload the terminal cup 18, so that when the lever arm assembly 28 is depressed by the user, the terminal cup 18 is rotated forward by the preload tension, releasing the data terminal from the retention pins 44 of the retention pin assembly 40. A lock 76 may be provided to prevent theft of the data terminal. This lock comprises a custom reversible cam 78 mountable on either side of the housing 12. The hook shaped cam 78 may rotate 90 degrees and hook around a post 80 on the base 32 of the lever arm assembly 28 preventing it from being depressed.

Figure 6:
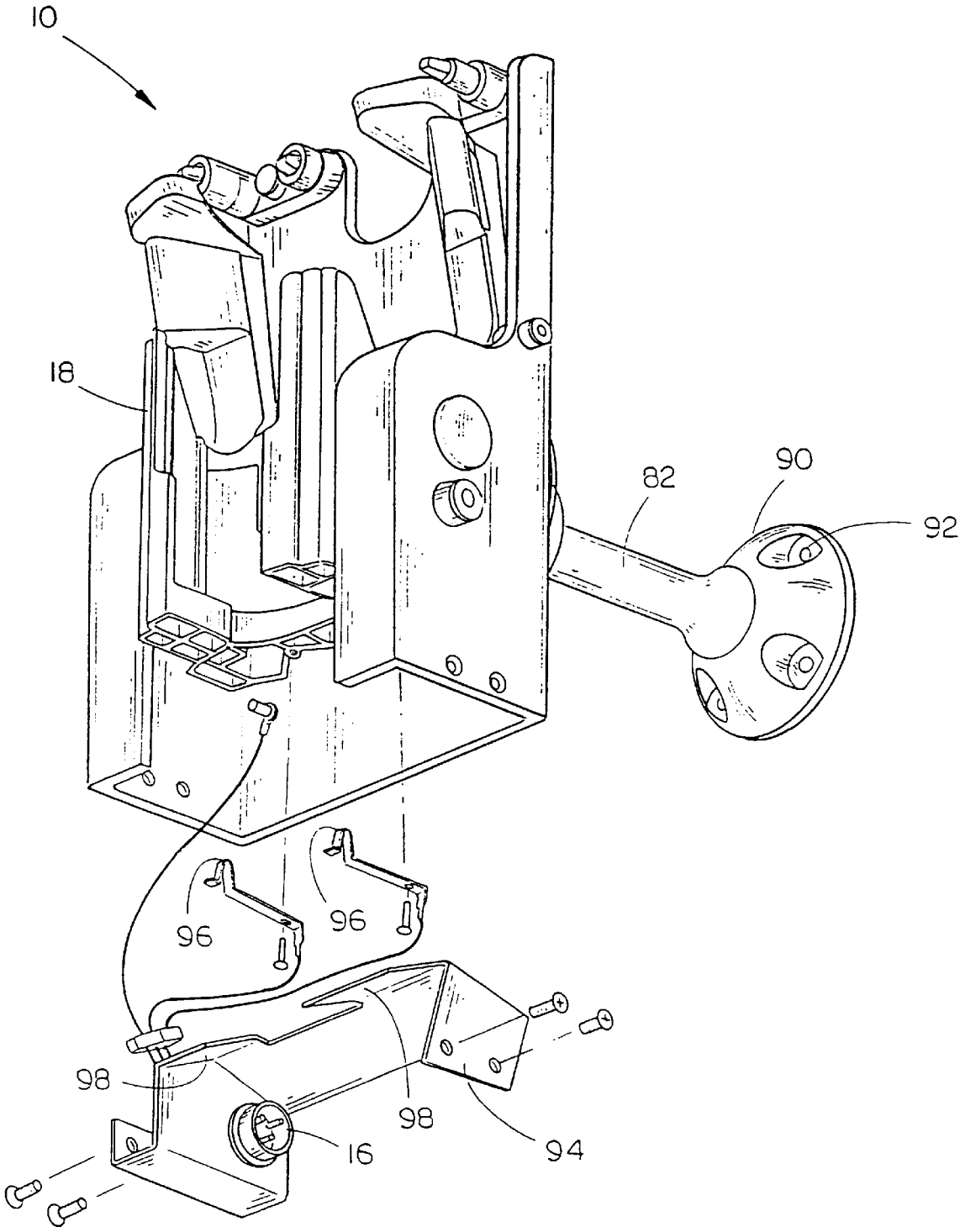
FIG. 6 is a perspective view depicting the docking apparatus attached to a pedestal for mounting within a vehicle.

As shown in FIG. 6, the vehicle dock 10 may comprise a recessed base plate 94. A connector 16, such as the connector described in the discussion of FIG. 1, may be positioned within the recess of the base plate 94 to at least partially shield the connector 16 from possible damage. The connector 16 may be interconnected to spring contacts 96 extending through the bottom of the terminal cup 18 and positioned to mate the data terminal. The base plate 94 may be shaped to have a downward sloping upper surface 98. Preferably, this surface 98 provides a stop to limit travel of the terminal cup 18 as the terminal cup is rotated forward to accept the insertion of a data terminal.

Figure 7:
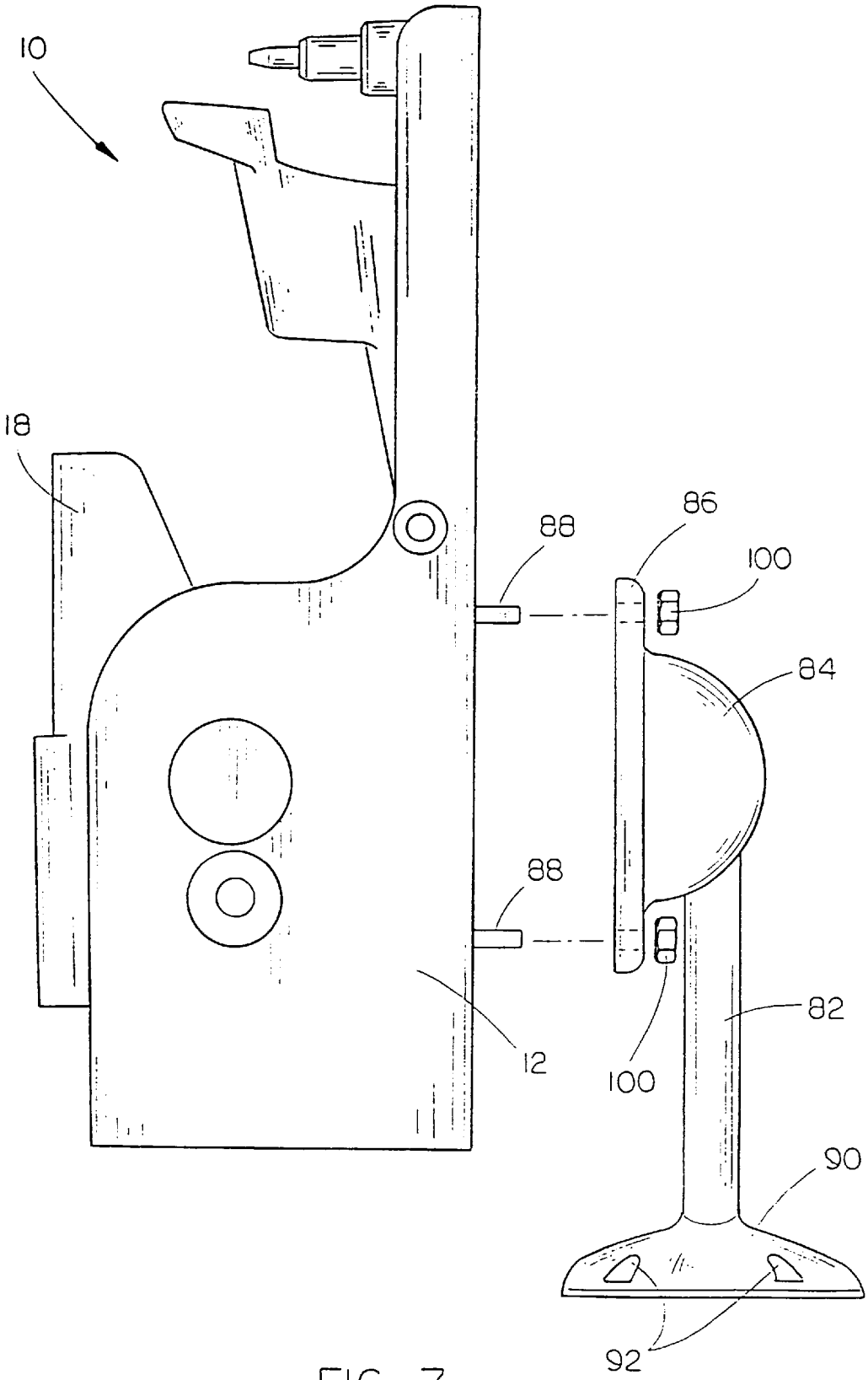
FIG. 7 is a side elevational view of the docking apparatus shown in FIG. 6.

Referring now to FIGS. 6 and 7, apparatus for mounting the vehicle dock 10 in a vehicle such as a truck, delivery van, or the like is shown. A pedestal mount 82 having a pivot 84 may mount the vehicle dock 10 to a surface within the cabin of a vehicle. The pivot 84 preferably allows the user to adjust the position of a data collection terminal (not shown) placed in the vehicle dock 10 by swiveling the dock about either its horizontal or vertical axis. The pedestal mount 82 may be attached to the housing 12 of vehicle dock 10 by a mounting bracket 86 having apertures spaced to accept threaded studs 88 extending from the back of the vehicle dock 10. Fasteners 98 such as nuts or the like may secure the vehicle dock 10 to the mounting bracket 86. Fasteners (not shown) such as screws, bolts, or the like may extend through apertures 92 in the base 90 of the pedestal mount 82 to secure the mount to a surface within the vehicle's cabin (not shown).

It is believed that the vehicle dock of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus for docking a portable data collection terminal, said apparatus comprising:

a housing;

a terminal cup having a channel into which said portable data collection terminal may be removably inserted, said terminal cup mounted in said housing so that said terminal cup may pivot around an axis to facilitate insertion and removal of said portable data collection terminal in said channel; and a retention pin assembly extending from said housing, said retention pin assembly suitable for engaging said portable data collection terminal to at least partially secure said portable data collection terminal in said docking apparatus.

2. The apparatus of claim 1, further comprising a lever arm assembly mounted in said housing, said lever arm assembly suitable for rotating said terminal cup to allow insertion and removal of said portable data collection terminal.

3. The apparatus of claim 2, wherein said lever arm assembly further comprises a guide for positioning said portable data collection terminal for insertion into said terminal cup and preventing lateral movement of said portable data collection terminal within said terminal cup thereafter.

4. The apparatus of claim 1, wherein said retention pin assembly extends perpendicularly from an upper wall of said housing and includes a retention pin suitable for being removably inserted into an aperture in said data collection terminal to at least partially secure said portable data collection terminal in said docking apparatus.

5. The apparatus of claim 1, wherein said housing comprises a rear support wall having an opening through which a pistol grip of said portable data collection terminal may protrude when said portable data collection terminal is inserted in said vehicle docking apparatus.

6. The apparatus of claim 2, further comprising a tension spring extending between said terminal cup and said lever arm assembly, said tension spring providing a preload to pull said terminal cup forward to allow insertion of said portable data collection terminal therein.

7. The apparatus of claim 1, wherein said retention pin assembly further comprises a rotatable base plate from which said retention pin extends.

8. The apparatus of claim 7, wherein said retention pin assembly further comprises a shortened retention pin extending from said base plate adjacent to said retention pin so that when said base plate is rotated said shortened retention pin is positioned to secure a portable data collection terminal having a pistol grip.

9. The apparatus of claim 1, further comprising a pedestal mount for securing the docking apparatus within a vehicle, said pedestal mount including a pivot adapted to allow rotation of the docking apparatus about its horizontal and vertical axis.

10. An apparatus for docking a portable data collection terminal in a vehicle, said apparatus comprising:

(a) a housing including distal side walls extending perpendicularly from a rear support wall;

(b) a terminal cup having a channel into which said portable data collection terminal may be removably inserted, said terminal cup mounted in said housing between said distal side walls so that said terminal cup may pivot around an axis to facilitate insertion and removal of said portable data collection terminal in said channel; and (c) a lever arm assembly mounted in said housing between said distal side walls so that said lever arm assembly may pivot around an axis, said lever arm suitable for rotating said terminal cup to allow insertion and removal of said portable data collection terminal;

wherein said rear support wall of said housing includes an opening for allowing a pistol grip of said portable data collection terminal to protrude when said portable data collection terminal is inserted in said vehicle docking apparatus.

11. The apparatus of claim 10, wherein said lever arm assembly further comprises a guide for positioning said portable data collection terminal for insertion into said terminal cup and preventing lateral movement of said portable data collection terminal within said terminal cup thereafter.

12. The apparatus of claim 10, further comprising a tension spring extending between said terminal cup and said lever arm assembly, said tension spring providing a preload to pull said terminal cup forward to allow insertion of said portable data collection terminal therein.

13. The apparatus of claim 10, further comprising a retention pin assembly having a retention pin extending perpendicularly from an upper part of said rear support wall of said housing, wherein said retention pin is suitable for being removably inserted into an aperture in said data collection terminal to at least partially secure said portable data collection terminal in said docking apparatus.

14. The apparatus of claim 13, wherein said retention pin assembly further comprises a rotatable base plate from which said retention pin extends.

15. The apparatus of claim 14, wherein said retention pin assembly further comprises a shortened retention pin extending from said base plate adjacent to said retention pin so that when said base plate is rotated said shortened retention pin is positioned to secure a portable data collection terminal having a pistol grip.

16. The apparatus of claim 10, further comprising a pedestal mount for securing the docking apparatus within said vehicle, said pedestal mount including a pivot adapted to allow rotation of the docking apparatus about its horizontal and vertical axis.

17. An apparatus for docking a portable data collection terminal in a vehicle, said apparatus comprising:

(a) a housing including distal side walls extending perpendicularly from a rear support wall;

(b) a terminal cup having a channel into which said portable data collection terminal may be removably inserted, said terminal cup mounted in said housing between said distal side walls so that said terminal cup may pivot around a horizontal axis to facilitate insertion and removal of said portable data collection terminal in said channel;

(c) a lever arm assembly having a guide for positioning said portable data collection terminal for insertion into said terminal cup and preventing lateral movement of said portable data collection terminal within said terminal cup thereafter, said lever arm assembly mounted in said housing between said distal side walls so that said lever arm assembly may pivot around a horizontal axis wherein said lever arm assembly is adapted to rotate said terminal cup to allow insertion and removal of said portable data collection terminal; and (d) a retention pin assembly having a retention pin extending perpendicularly from an upper part of said rear support wall of said housing, wherein said retention pin is adapted to be removably inserted into an aperture in said data collection terminal to at least partially secure said portable data collection terminal in said docking apparatus.

18. The apparatus of claim 17, wherein said rear support wall of said housing includes an opening through which a pistol grip of said portable data collection terminal may protrude when said portable data collection terminal is inserted in said vehicle docking apparatus.

19. The apparatus of claim 17, further comprising a tension spring extending between said terminal cup and said lever arm assembly, said tension spring providing a preload to pull said terminal cup forward to allow insertion of said portable data collection terminal therein.

20. The apparatus of claim 17, wherein said retention pin assembly further comprises a rotatable base plate from which said retention pin extends, said base plate affixed to said housing by a thumbscrew.

21. The apparatus of claim 20, wherein said retention pin assembly further comprises a shortened retention pin extending from said base plate adjacent to said retention pin so that when said base plate is rotated said shortened retention pin is positioned to secure a portable data collection terminal having a pistol grip.

22. The apparatus of claim 17, further comprising a pedestal mount for securing the docking apparatus within said vehicle, said pedestal mount including a pivot adapted to allow rotation of the docking apparatus about its horizontal and vertical axis.

* * * * *